US010348043B2

(12) United States Patent
Youtsey

(10) Patent No.: US 10,348,043 B2
(45) Date of Patent: Jul. 9, 2019

(54) PROGRESSIVE LOCK WASHER ASSEMBLY FOR COAXIAL CABLE CONNECTORS

(71) Applicant: PCT International, Inc., Mesa, AZ (US)

(72) Inventor: Timothy L. Youtsey, Tempe, AZ (US)

(73) Assignee: PCT International, Inc., Mesa ( * ) Notice: Subject to any disclaimer, the term of this patent is extended or adjusted under 35 U.S.C. 154(b) by 0 days.

(21) Appl. No.: 15/855,229

(22) Filed: Dec. 27, 2017

(65) Prior Publication Data

US 2018/0183192 A1 Jun. 28, 2018

Related U.S. Application Data

(60) Provisional application No. 62/439,859, filed on Dec. 28, 2016.

(51) Int. Cl.

| | |
|---|---|
| ***H01R 9/05*** | (2006.01) |
| ***H01R 24/40*** | (2011.01) |
| ***H01R 13/15*** | (2006.01) |
| ***H01R 13/622*** | (2006.01) |
| *H01R 103/00* | (2006.01) |

(52) U.S. Cl.
CPC ..... *H01R 24/40* (2013.01); *H01R 13/15* (2013.01); *H01R 13/622* (2013.01); *H01R 2103/00* (2013.01)

(58) Field of Classification Search
CPC ..... H01R 13/622; H01R 2103/00; H01R 9/0521; H01R 9/0518
USPC ..... 439/321, 322, 578, 583–585
See application file for complete search history.

(56) References Cited

U.S. PATENT DOCUMENTS

| | | | |
|---|---|---|---|
| 3,199,061 | A | 8/1965 | Johnson et al. |
| 4,377,320 | A | 3/1983 | Lanthrop et al. |
| 4,407,529 | A | 10/1983 | Holman |
| 4,990,106 | A | 2/1991 | Szegda |
| 5,393,244 | A | 2/1995 | Szegda |
| 5,466,173 | A | 11/1995 | Down |
| 5,498,175 | A | 3/1996 | Yeh et al. |
| 5,501,616 | A | 3/1996 | Holliday |
| 5,879,191 | A | 3/1999 | Burris |
| 6,010,289 | A | 1/2000 | Distasio et al. |
| 6,042,422 | A | 3/2000 | Youtsey |

(Continued)

FOREIGN PATENT DOCUMENTS

| | | | |
|---|---|---|---|
| GB | 1304364 | A | 1/1973 |
| WO | 2007055871 | A1 | 5/2007 |

*Primary Examiner* — Thanh Tam T Le
(74) *Attorney, Agent, or Firm* — Thomas W. Glavani, P.C.; Thomas W. Galvani

(57) ABSTRACT

A cable connector includes a body having a longitudinal axis, an inner post, an outer barrel mounted to the inner post, and a fitting mounted to the inner post. The inner post includes a front, a rear, and an outwardly-directed front flange at the front. The fitting includes a front, a rear, and an inwardly-directed rear flange at the rear. The fitting is mounted on the inner post so that the front and rear flanges overlap to define a toroidal volume. A wave washer and a lock washer are each carried in the toroidal volume. When the fitting is applied to a female post, the wave washer and the lock washer are compressed between the front and rear flanges and exert an axial bias on the front and rear flanges to prevent axial separation of the fitting and the female post.

10 Claims, 7 Drawing Sheets

(56) References Cited

U.S. PATENT DOCUMENTS 6,254,071 B1 7/2001 Greenhill
6,425,782 B1 7/2002 Holland
6,648,683 B2 11/2003 Youtesy
6,712,631 B1 3/2004 Youtsey
6,767,248 B1 7/2004 Hung
7,144,272 B1 12/2006 Burris et al.
7,288,002 B2 10/2007 Rodrigues et al.
7,364,462 B2 4/2008 Holland
7,377,809 B2 5/2008 Dyck
7,404,373 B2 7/2008 Youtsey
7,510,432 B2 3/2009 Entsfellner
7,527,524 B1 5/2009 Coleman et al.
7,566,236 B2 * 7/2009 Malloy ..... H01R 13/622 439/321
7,753,727 B1 7/2010 Islam et al.
7,824,216 B2 * 11/2010 Purdy ..... H01R 24/40 439/578
7,934,953 B1 5/2011 Solis
7,976,339 B2 7/2011 Buck et al.
7,997,930 B2 8/2011 Ehret et al.
8,029,316 B2 10/2011 Snyder et al.
8,444,433 B2 5/2013 Snyder et al.
8,444,445 B2 * 5/2013 Amidon ..... H01R 9/0524 439/583
8,469,739 B2 6/2013 Rodrigues et al.
8,517,763 B2 * 8/2013 Burris ..... H01R 9/0524 439/578
8,579,658 B2 11/2013 Youtsey
8,585,439 B2 11/2013 Amidon et al.
8,591,244 B2 * 11/2013 Thomas ..... H01R 9/0524 439/321
8,636,541 B2 * 1/2014 Chastain ..... H01R 9/05 439/578
8,690,603 B2 4/2014 Bence et al.
8,753,147 B2 6/2014 Montena
8,777,661 B2 * 7/2014 Holland ..... H01R 24/38 439/108
8,840,429 B2 9/2014 Thomas et al.
8,882,250 B2 11/2014 Youtsey
8,888,526 B2 * 11/2014 Burris ..... H01R 24/40 439/578
8,894,440 B2 11/2014 Rodrigues et al.
8,915,751 B2 12/2014 Wood
8,915,753 B2 * 12/2014 Holland ..... H01R 9/05 439/578
8,915,754 B2 * 12/2014 Montena ..... H01R 9/05 439/578
8,944,846 B2 2/2015 Lee
9,039,446 B2 5/2015 Youtsey
9,040,822 B2 5/2015 Lopez
9,071,019 B2 6/2015 Burris et al.
9,083,113 B2 7/2015 Wild et al.
9,257,780 B2 2/2016 Thomas et al.
9,496,661 B2 11/2016 Purdy et al.
9,722,330 B2 8/2017 Edmonds
9,859,631 B2 * 1/2018 Burris ..... H01R 13/622
9,865,943 B2 * 1/2018 Montena ..... H01R 9/05
2002/0164900 A1 11/2002 Youtsey
2003/0114112 A1 6/2003 Strater et al.
2004/0048514 A1 3/2004 Kodaira
2005/0148236 A1 7/2005 Montena
2006/0015921 A1 1/2006 Vaughan
2009/0053928 A9 2/2009 Entsfellner
2010/0125877 A1 5/2010 Wells et al.
2010/0223651 A1 9/2010 Wang
2010/0261380 A1 10/2010 Skeels et al.
2010/0297875 A1 11/2010 Purdy et al.
2012/0021642 A1 1/2012 Zraik
2012/0270439 A1 10/2012 Tremba et al.
2012/0329311 A1 12/2012 Duval et al.
2013/0330967 A1 12/2013 Youtsey
2014/0342594 A1 11/2014 Montena
2015/0007246 A1 1/2015 Ariesen
2015/0050825 A1 2/2015 Krenceski et al.
2015/0118901 A1 4/2015 Burris
2015/0162675 A1 6/2015 Davidson, Jr. et al.
2015/0180141 A1 6/2015 Wei
2015/0229044 A1 8/2015 Youtsey

* cited by examiner

PROGRESSIVE LOCK WASHER ASSEMBLY FOR COAXIAL CABLE CONNECTORS

CROSS-REFERENCE TO RELATED APPLICATIONS

This application the benefit of U.S. Provisional Application No. 62/439,859, filed Dec. 28, 2016, which is hereby incorporated by reference.

FIELD OF THE INVENTION

The present invention relates generally to electronic devices, and more particularly to coaxial cable connectors.

BACKGROUND OF THE INVENTION

Coaxial cables transmit radio frequency ("RF") signals between transmitters and receivers and are used to interconnect televisions, cable boxes, DVRs, DVD players, satellite receivers, modems, and other electrical devices and electronic components. Typical coaxial cables include an inner conductor surrounded by a flexible dielectric insulator, a foil layer and/or a metallic braided sheath or shield, and a flexible polyvinylchloride jacket. The RF signal is transmitted through the inner conductor. The conductive sheath provides a ground and inhibits electrical and magnetic interference with the RF signal in the inner conductor.

Coaxial cables must be fit with cable connectors to be coupled to female posts of electronic components. Connectors typically have a connector body, a threaded fitting or coupling nut mounted for rotation on an end of the connector body, a bore extending into the connector body from an opposed end to receive the coaxial cable, and an inner post within the bore coupled in electrical communication with the fitting. Generally, connectors are crimped onto a prepared end of a coaxial cable to secure the connector to the coaxial cable. The connectors must also maintain electrical connection, continuity, and signal shielding with the female post of an electronic component despite rotation, tugging, bending, or other movement of the cable and the connector. Movement of the cable and the connector may occur suddenly if an object contacts the cable or connector, but may also occur slowly over time, such as from cyclical heating and cooling or wind loads on outside installations.

Some approaches to maintaining continuity have focused on maintaining a connection between the coupling nut and the female post by biasing the nut in an axial direction so as to force the nut into continuity. This has generally been accomplished by loading the nut axially with a continuity washer or other shimming device. Typically, such biasing devices are disposed axially between the nut and the body of the connector and urge the nut axially forward into contact with a forward flange on the post. However, should the biasing device not provide an even force continuously around the entire device, the nut may not mate continuously flush against the post, which can lead to leaks in signal, degradation of continuity, and impingement of RF interference into the connector. Further, if the connector is bent, such as frequently occurs when the cable extending from the connector flexes or is bent, the nut will not mate continuously flush against the post, leading to the above-stated problems. These problems are accentuated when the nut is not sufficiently tightened onto the electronic component, which often occurs when homeowner or other end user applies the connector onto the female post. An improved connector is needed which provides reliable continuity despite the level or accuracy of torque on the connector.

SUMMARY OF THE INVENTION

A cable connector includes a body having a longitudinal axis, an inner post, an outer barrel mounted to the inner post, and a fitting mounted to the inner post. The inner post includes a front, a rear, and an outwardly-directed front flange at the front. The fitting includes a front, a rear, and an inwardly-directed rear flange at the rear. The fitting is mounted on the inner post so that the front and rear flanges overlap to define a toroidal volume. A wave washer and a lock washer each carried in the toroidal volume. When the fitting is applied to a female post, the wave washer and the lock washer are compressed between the front and rear flanges and exert an axial bias on the front and rear flanges to prevent axial separation of the fitting and the female post.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
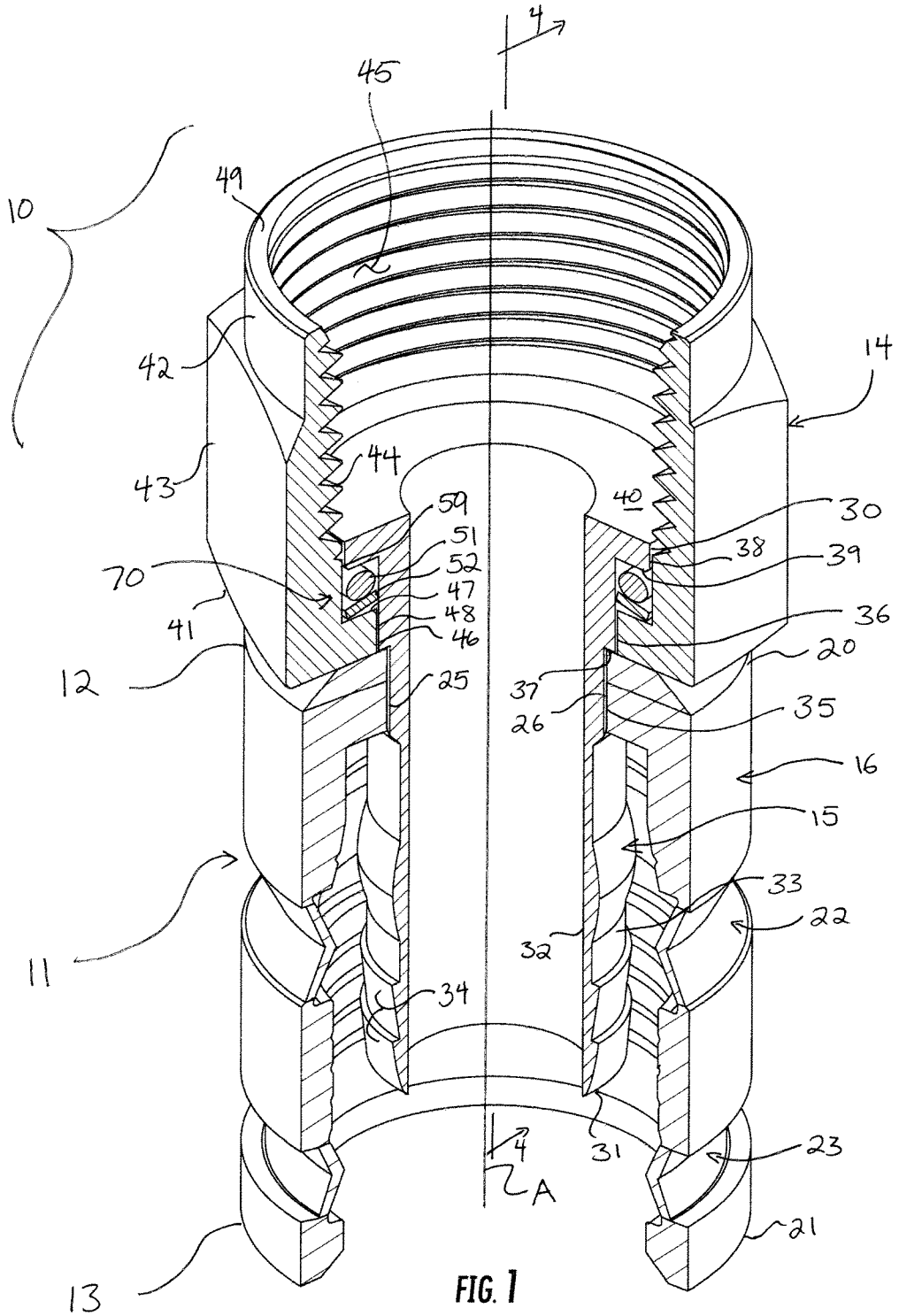
FIG. 1 is a partial section view of a coaxial cable connector with a progressive lock washer assembly.
Figure 2:
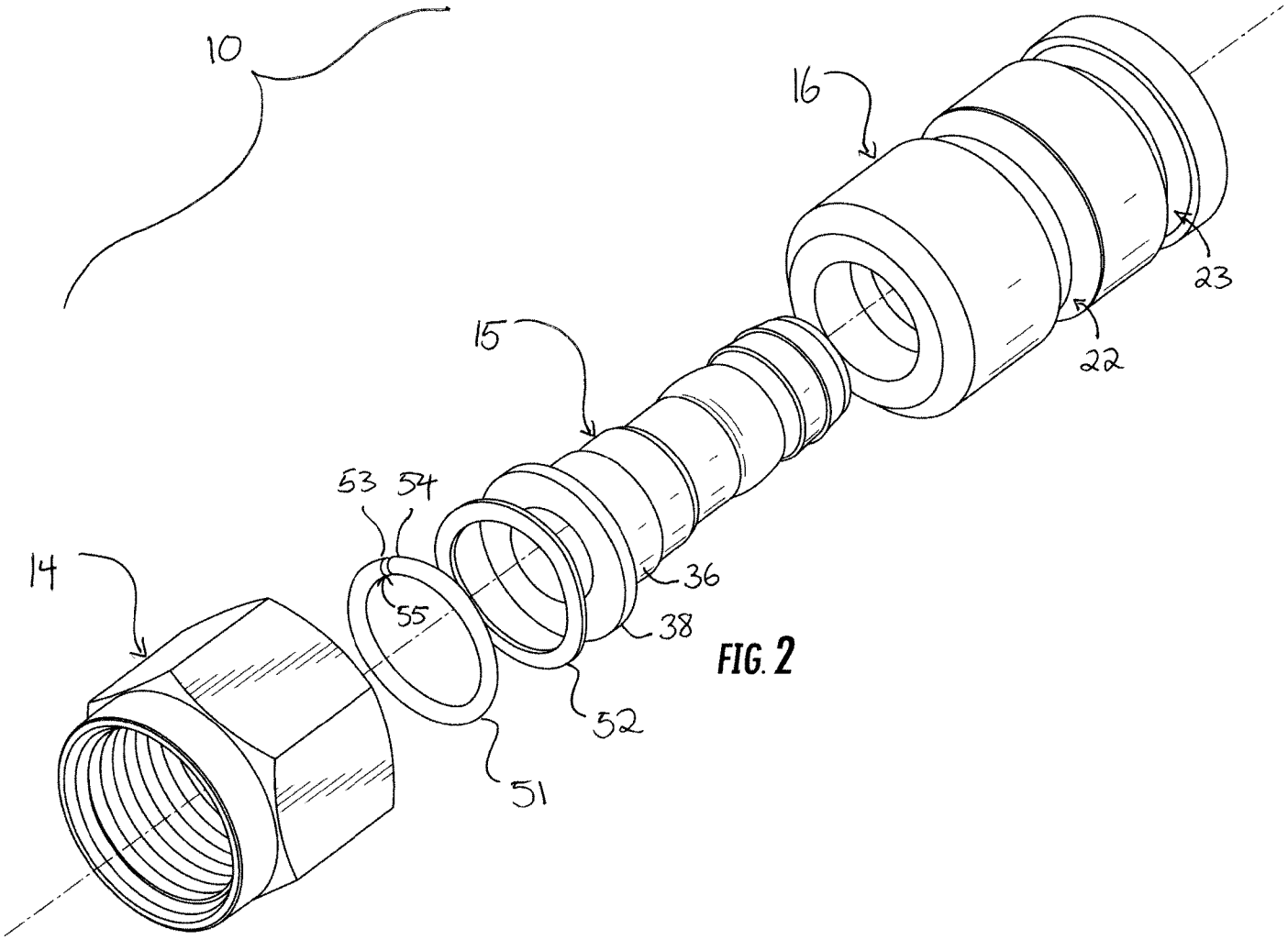
FIG. 2 is an exploded view of the coaxial cable connector of FIG. 1.

Reference now is made to the drawings, in which the same reference characters are used throughout the different figures to designate the same elements. FIGS. 1 and 2 illustrate a coaxial cable connector 10 which effectively establishes and maintains electrical continuity without the need for tightening, compressing, or otherwise forcing the connector 10 or parts thereof onto a female post of an electronic component. FIG. 1 shows a partial-section view in which a quarter-core has been removed from the connector 10, and FIG. 2 shows an exploded view of the connector 10. All of the drawings illustrate the connector 10 without a cable applied, because such illustrations are unnecessary since one having ordinary skill in the art will readily appreciate such arrangements.

Briefly, as a matter of explanation, the phrase "electronic component," as used throughout the description, includes any electrical device having a female post or mating port to receive a male coaxial cable connector for the transmission of RF signals such as cable television, satellite television, internet data, and the like. The term "electronic component" also specifically includes wall jacks, wall installations, exterior cable box hookups, and like components. Further, the embodiment of the connector 10 shown throughout the drawings is an F connector for use with an RG6 coaxial cable for purposes of example, but it should be understood that the description below is also applicable to other types of coaxial cable connectors and other types of cables. Moreover, much of the structure of the connector 10 is non-limiting and non-specific, as will be explained below.

The connector 10 includes a body 11 having opposed front and rear ends 12 and 13, a fitting 14 mounted for rotation on the front end 12 of the body 11, an inner post 15, and an outer barrel 16 proximate the rear end 13 of the body 11. The connector 10 has rotational symmetry with respect to a longitudinal axis A illustrated in FIG. 1, which axis A extends centrally through the connector 10. The connector 10 is for crimping onto a coaxial cable, which typically will include an inner conductor that, when the cable is applied to the connector 10, extends through the connector 10 and out of the connector 10 at the fitting 14.

The outer barrel 16 shown in the drawings is non-specific and non-critical to the connector 10, and the embodiment of the outer barrel 16 may be substituted with other suitable outer barrels for coaxial cable connectors. In the embodiment shown in FIG. 1, the outer barrel 16 has a front 20, an opposed rear 21, and two compression bands 22 and 23 formed in a sidewall 24 therebetween. The compression bands are similar to the compression bands of U.S. patent application Ser. No. 15/217,903, filed Jul. 22, 2016, now U.S. Pat. No. 9,722,330, which is incorporated herein by reference. The outer barrel 16 has rotational symmetry with respect to the axis A, and is constructed from a material or combination of materials having rigid, strong, and electrically non-conductive characteristics, such as plastic.

The compression bands 22 and 23 are identical, and are thinned portions of the sidewall of the outer barrel 16 so as to create areas of flexion and deformation in the outer barrel 16. The compression band 22 includes a first wall, a second wall, and a bend formed therebetween. The first and second walls project radially inward toward from the axis A. The first wall is formed proximate to the rear 21, the second wall is formed forward of the first wall, and the bend is a flexible, thin, annular portion of the sidewall 24 of the outer barrel 16 between the first and second walls, defining a living hinge therebetween. The first and second walls are oriented obliquely with respect to the longitudinal axis A when the outer barrel 16 is in an uncompressed condition, and they converge toward each other. A V-shaped annular channel is thus defined between the first and second walls. When the connector 10 is compressed axially, such as would occur when it is applied onto the cable and compressed in a compression tool, the compression band 22 deforms, with the first and second walls collapsing and moving into each other, causing the bend to flex, and urging it radially inward toward the inner post 15. Regardless of the compression band structure of the outer barrel 16, the outer barrel terminates in a radially inwardly-turned flange or lip 25 at the front 20, which includes a forwardly-directed, annular, contact face 26. The lip 25 couples the outer barrel 16 to the inner post 15 with a snug fit.

Still referring to FIG. 1, the inner post 15 is an elongate sleeve extending along the axis A which has rotational symmetry about the axis A. The inner post 15 has a front 30, an opposed rear 31, and opposed inner and outer surfaces 32 and 33. The embodiment of the inner post 15 shown throughout the drawings is considered a "long" post, extending nearly entirely to the rear 21 of the outer barrel 16. In other embodiments of the connector 10, the inner post 15 is a "short" post, such as the type shown in U.S. Pat. No. 9,722,330, wherein the end 31 of the inner post 15 terminates substantially in front of the rear 21 of the outer barrel 16.

The outer surface 33 at the rear 31 of the inner post 15 is formed with several annular ridges 34 projecting toward the front 30 and extending radially outward from axis A. As the term is used in this description, "radial" means directed, extending, or aligned along a radius extending from the axis A. Moreover, the term "axial" means directed, extending, or aligned parallel to the axis A. Still further, the terms "forward," "ahead," and the like are used to generally indicate a direction toward the front end 12 of the body 11, and the terms "rearward," "behind," and the like are used to generally indicate a direction toward the rear end 13 of the body 11. The ridges 34 are axially spaced apart from each other proximate to the rear 31 of the inner post 15. The ridges 34 provide grip on the cable when the cable is applied in the coaxial cable connector 10 to hold the cable and prevent the cable from backing out of the connector 10.

The inner post 15 varies in outer diameter along its length, and as such, includes a number of raised or tiered annular faces toward the front 30, each spaced apart axially along the inner post 15. One of the faces is a contact face 35 for the inwardly-directed lip 25 of the outer barrel 16, opposing the contact face 26 on the inner post 15. The contact face 35 is a smooth, annular face having an outer diameter corresponding to the inner diameter of the lip 25, such that the lip 25 is snug fit onto the contact face 35; the outer barrel 16 is thus mounted to the inner post 15 at the contact face 35 in snug-fit engagement.

A second face—a fitting face 36—is forward of the contact face 35. The fitting face 36 has a larger diameter than the contact face 35 and is thus stepped out radially outwardly with respect to the contact face 35. A rearwardly-directed, annular shoulder 37 is formed between the contact and forward faces 35 and 36. While the contact and fitting faces 35 and 36 are axially aligned, the shoulder 37 is radially aligned. The shoulder 37 confronts the front 20 of the outer barrel 16 and thus limits relative axial movement of the outer barrel 16 over the inner post 15.

A front flange 38 terminates the fitting face 36 at its forward end, extending radially outward to an outer diameter greater than the outer diameter of the fitting face 36. The front flange 38 has a radially-aligned, forward face 40 and an opposed radially-aligned, rear face 39 directed rearward. Both the rear and forward faces 39 and 40 of the front flange 38 are oriented substantially normal to the fitting face 36 of the inner post 15.

Referring still to FIG. 1 primarily, the fitting 14 is fit and secured onto the inner post 15 near the front flange 38 of the inner post 15. In the embodiment shown throughout the drawings, the fitting 14 is a coupling nut. In other embodiments, the fitting 14 is a collet, push-on connector, or some other like fitting. The fitting 14 is constructed of a material or combination of materials having strong, hard, rigid, durable, and high electrically-conductive material characteristics, such as metal.

The fitting 14 is a sleeve having a front 49 and an opposed rear 41, an integrally-formed ring portion 42 proximate to the front 49, and an integrally-formed nut portion 43 proximate to the rear 41. The nut portion 43 is mounted at the front end 12 of the body 11 on the inner post 15 for rotation about the axis A, so that the entire fitting 14 is mounted for free rotation on the inner post 15.

The ring portion 42 has a smooth annular outer surface, while the nut portion 43 has a hexagonal outer surface 44 to receive the jaws of a tool. The ring and nut portions share a common inner surface 44. The inner surface 44 is formed with radially inwardly-directed threads for threaded engagement with a female post of an electronic component. An interior space 45 extends into the fitting 14 from a mouth formed at the front 49 of the nut 14 to an opening formed at the rear 41. The interior space 45 is bound by the shared inner surface 44 of the ring and nut portions.

The fitting 14 is carried on the inner post 15. At its rear 41, the fitting 14 includes a radially inwardly-directed rear flange 46 with a forward face 47 and an inner face 48. The rear flange 46 has an inner diameter at the inner face 48, which inner diameter corresponds to the outer diameter of the fitting face 36 of the inner post 15, such that the rear flange 46 has a snug bearing fit on the fitting face 36. This snug bearing fit mounts the fitting 14 to the inner post 15. The rear flange 46 is also in contact with the front 20 of the outer barrel 16 at the lip 25, thereby limiting axial movement of the fitting 14 and the outer barrel 16 with respect to each other. The rear face of the rear flange 46 is thus co-radial with the shoulder 37 on the inner post 15, meaning it is registered and aligned radially with the shoulder 37. In front of the rear flange 46, and behind the threaded inner surface 44 of the fitting 14, a plain inner surface 59 extends axially. The plain inner surface 59 is inwardly directed, normal to the rear flange 46, and smooth.

A toroidal volume 50 is between the fitting 14 and the inner post 15. The toroidal volume 50 is defined radially between the fitting face 36 of the inner post 15 and the plain inner surface 59 of the fitting 14, and is defined axially between the rear face 39 of the front flange 38 on the inner post 15 and the forward face 47 of the fitting 14. The toroidal volume 50, in the embodiment shown in the drawings, thus has a roughly rectangular cross-section; this may change, however, depending on the orientation of the contact face 36, the rear face 39, the plain inner surface 59, and the forward face 47, as occurs when different fittings or inner posts are used. For instance, when the fitting 14 terminates with a rear flange 46 that has an oblique forward face 47, the toroidal volume will have a parallelogram cross-section.

The toroidal volume 50 has a long dimension in the axial direction compared to a short dimension in the radial direction. The toroidal volume 50 is aligned so that its long dimension is parallel to the axial direction and its short dimension is parallel to the radial direction. One bounding side of the long dimension of the toroidal volume 50, along the outer side of the toroidal volume 50, is defined by the plain inner surface 59 of the nut 14. The opposing bounding side of the long dimension, or the inner surface of the toroidal volume 50, is defined by the fitting face 36 of the inner post 15. One bounding side of the short dimension, at the front end of the toroidal volume 50, is defined by the rear face 39 of the inner post 15. The opposing bounding side of the short dimension, or the rear end of the toroidal volume 50, is defined by the forward face 47 of the rear flange 46.

Two locking elements, defining a progressive lock washer assembly 70, are carried within the toroidal volume 50. The progressive lock washer assembly 70 provides a continuous and sufficient axial load between the fitting 14 and the inner post 15 to maintain electrical continuity between the fitting 14 and the inner post 15. The progressive lock washer assembly 70 provides the connector 10 with a very low torque requirement, so that homeowners and other end users can easily apply the connector 10 manually without a tool, and without concern that the connector 10 may be insufficiently tightened.

The locking elements of the progressive lock washer assembly 70 are uniquely combined and arranged, so that their combination and arrangement allows the connector 10 to maintain electrical continuity with an electronic component regardless of the level of torque applied to the fitting 14, while also preventing accidental loosening or separation of the connector 10 from the electronic component. The locking elements of the progressive lock washer assembly 70 include a wave washer 51 and a lock washer 52. The wave washer 51 and the lock washer 52 are confined within the toroidal volume 50, and the wave washer 51 is disposed in front of the toroidal volume 50.

Figure 3A:
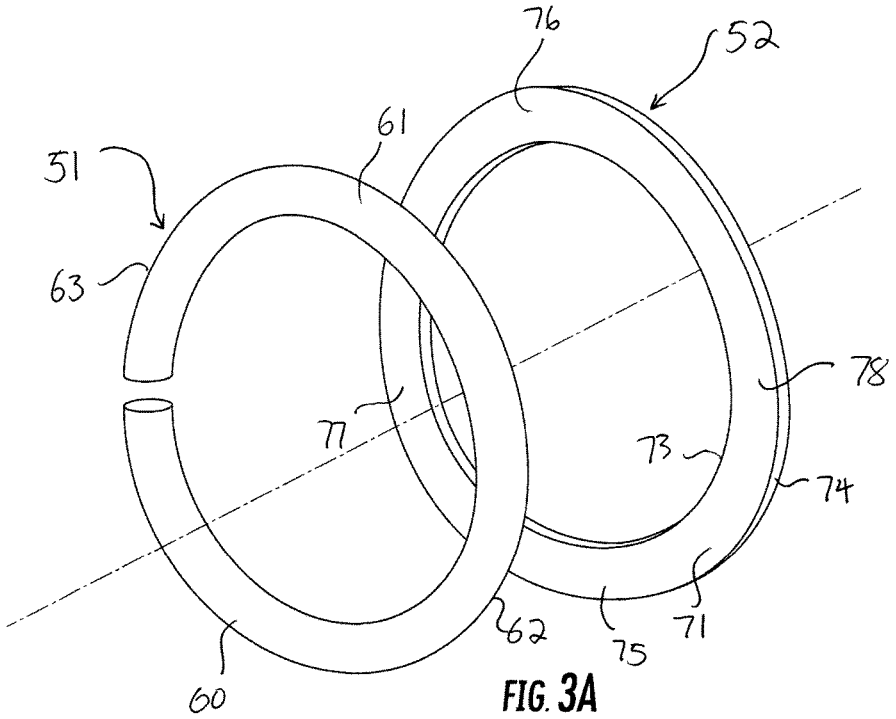
FIGS. 3A and 3B are perspective and side elevation views, respectively, showing a wave washer and lock washer of the progressive lock washer assembly in isolation.
Figure 3B:
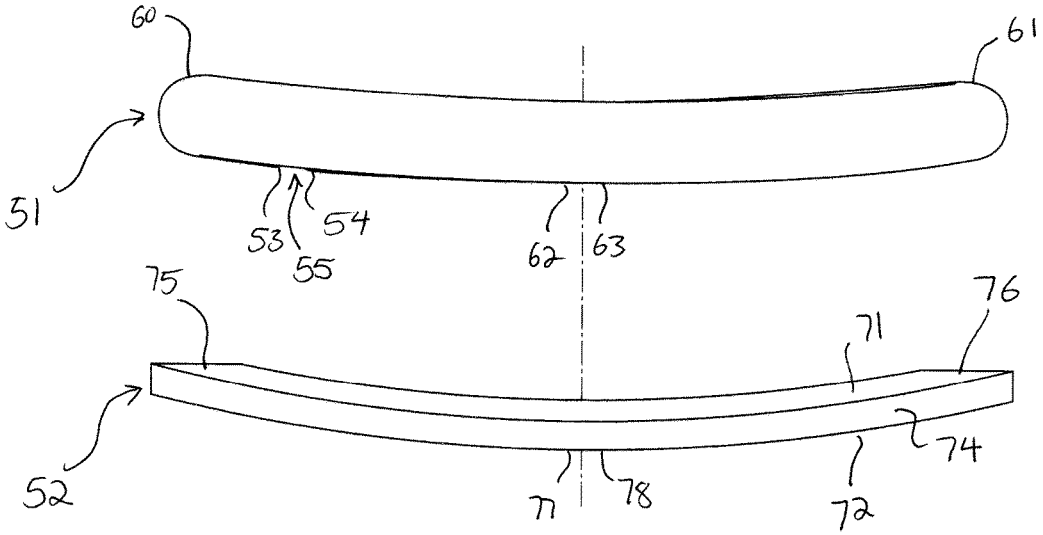

The exploded view of FIG. 2 illustrates the wave washer 51 and the lock washer 52. The wave washer 51 is a severed- or split-ring washer. It includes a toroidal body having a circular cross-section formed with two free ends 53 and 54 defining a sever or gap 55. The free ends 53 and 54 are spaced apart by the gap 55. FIGS. 3A and 3B show the wave washer 51 in more detail. The wave washer 51 is not planar flat but is instead bent or bowl-shaped, and thus has four lobes arranged about its extent. Two opposed forward lobes 60 and 61 are bent forwardly, defining convex sections of the wave washer 51 (from a forward perspective). Two opposed rearward lobes 62 and 63 are bent rearwardly to define concave sections of the wave washer 51. From behind, the forward lobes 60 and 61 are concave and the rearward lobes 62 and 63 are convex. The forward lobes 60 and 61 are circumferentially spaced-apart or offset from each other and from the rearward lobes 62 and 63: the peak of the forward lobe 60 is approximately ninety degrees offset with respect to the peaks of the rearward lobes 62 and 63, which are also each approximately ninety degrees offset with respect to the peak of the forward lobe 60. In other words, the lobes 60-63 are each spaced apart by quarter-arcs of the body of the wave washer 51. The lobes 60 and 61 are diametrically offset from each other; the lobes 62 and 63 are diametrically offset from each other.

The lock washer 52 is disposed behind the wave washer 51 when installed in the connector 10. The lock washer 52 includes a continuous solid annular body with a parallelogram cross-section having a flat front face 71, a flat rear face 72, an inner edge 73, and an outer edge 74. The lock washer 52 has a bent or bowl-shaped configuration defining four lobes around its extent: two forward lobes 75 and 76 and two rearward lobes 77 and 78. The forward lobes 75 and 76 are bent forwardly, thus defining convex sections of the lock washer 52 (from a forward perspective). The two opposed rearward lobes 77 and 78 are bent rearward to define concave sections of the lock washer 52. From behind, the forward lobes 75 and 76 are concave and the rearward lobes 77 and 78 are convex. The forward lobes 75 and 76 are circumferentially offset from each other and from the rearward lobes 77 and 78: the peak of the forward lobe 75 is approximately ninety degrees offset with respect to the peaks of the rearward lobes 77 and 78, which are also each approximately ninety degrees offset with respect to the peak of the forward lobe 76. In other words, the lobes 75-78 are each spaced apart by quarter-arcs of the body of the lock washer 52. The lobes 75 and 76 are diametrically offset from each other; the lobes 77 and 78 are diametrically offset from each other.

Figure 4A:
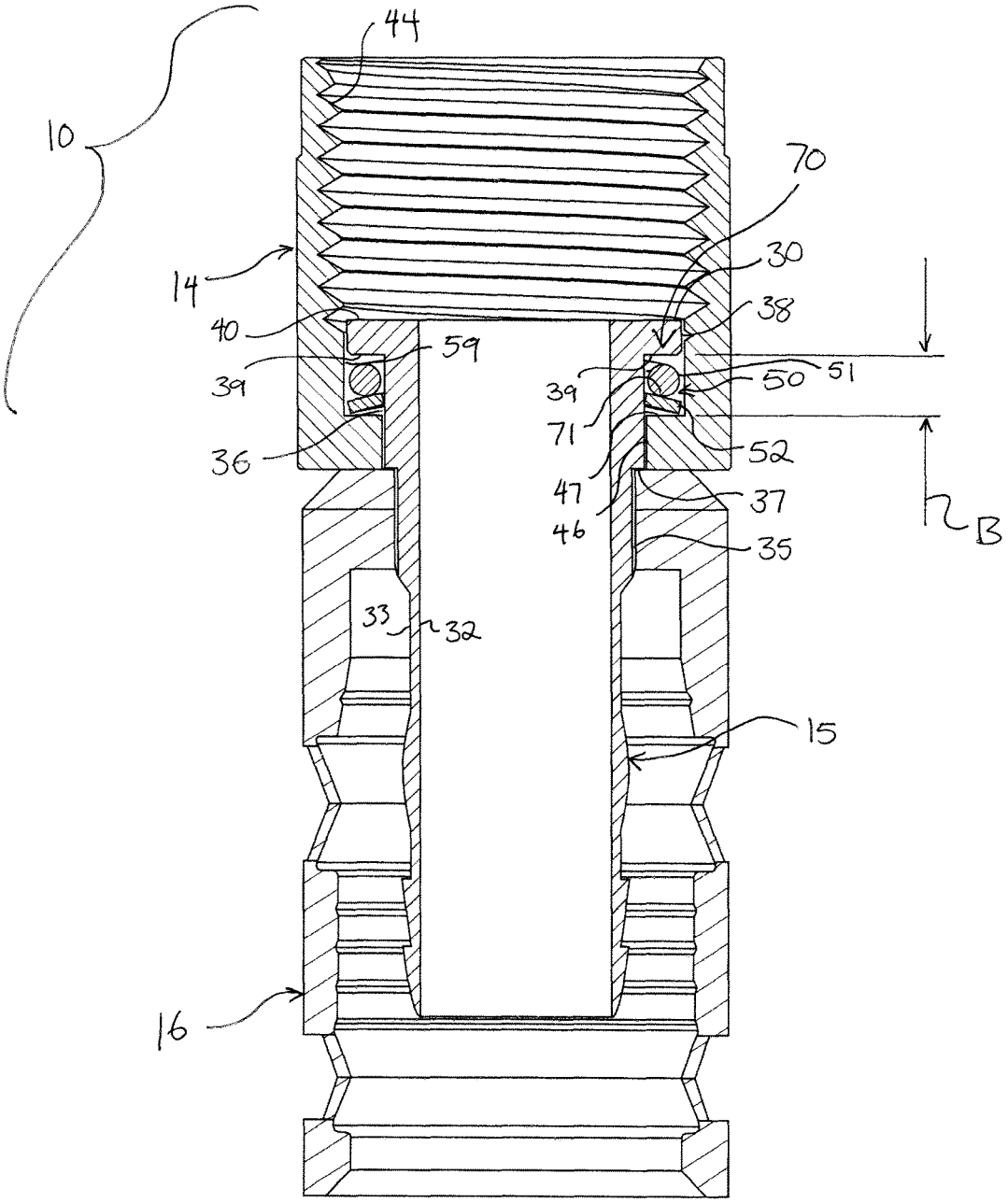
FIGS. 4A and 4B are section views taken along the line 4-4 in FIG. 1 showing the progressive lock washer assembly loosened and compressed, respectively, within the coaxial cable connector.
Figure 4B:
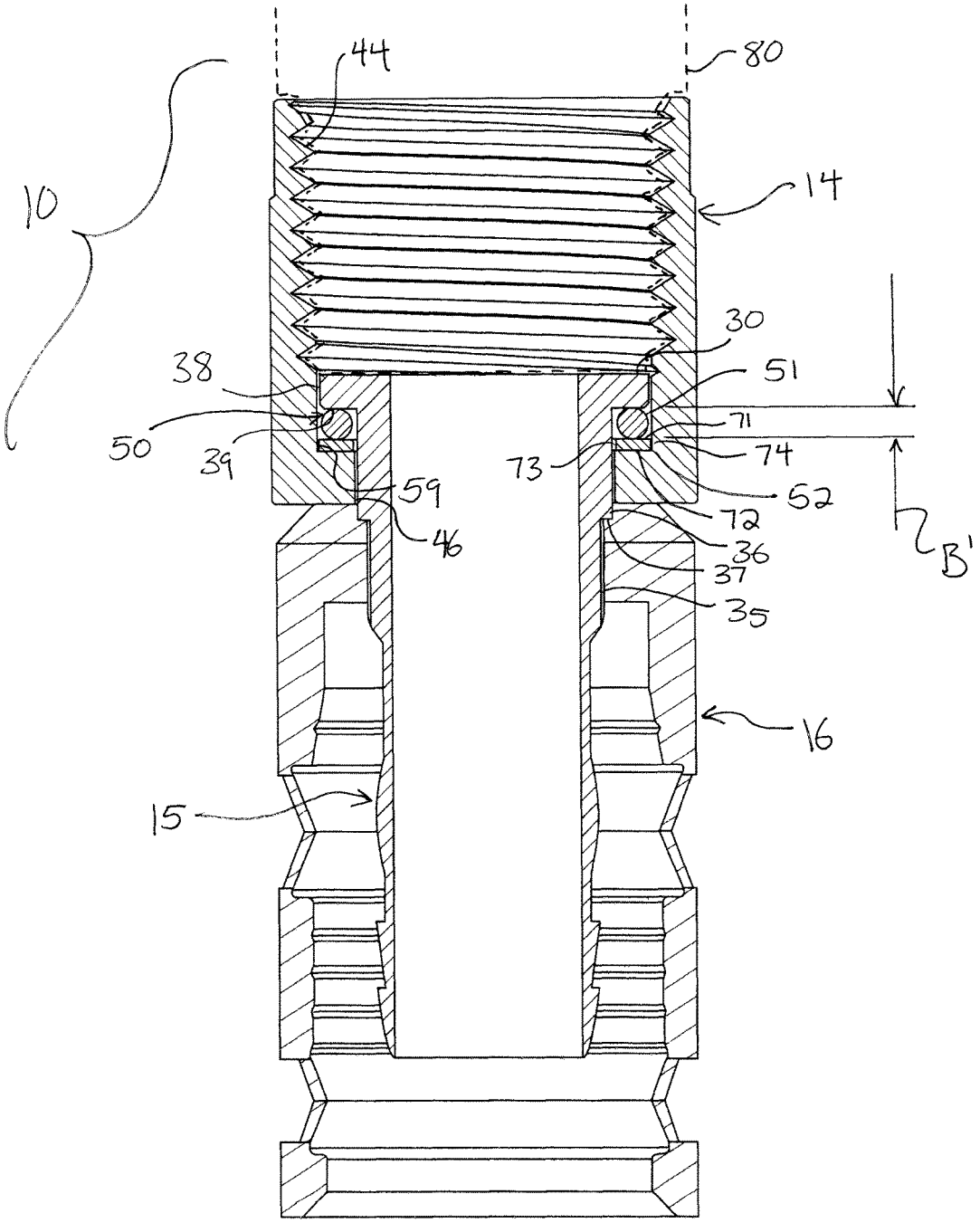

Turning now to FIGS. 4A and 4B, which are bisecting section views taken along the line 4-4 in FIG. 1, the connector 10 is shown in two states. FIG. 4A illustrates the arrangement of the connector 10 when it is free of a female post of an electronic component, or when it has been loosely applied thereto (this is characterized as a "loose condition" of the progressive lock washer assembly 70), while FIG. 4B illustrates the connector 10 when it has been manually tightened onto a female post 80 (this is characterized as an "applied condition"). Of course, FIGS. 4A and 4B do not depict a coaxial cable extending out of the connector 10, as would be appropriate when a connector 10 is being installed on a female post. Further, FIGS. 4A and 4B also do not show different compression states of the connector 10 (such as with the compression bands 22 and 23 deformed) as would be normal when the connector 10, installed on a cable, is being installed on the female post 80. Such illustrations are not necessary for understanding of the operation of the progressive lock washer assembly 70.

In the loose condition of the progressive lock washer assembly 70, shown in FIG. 4A, the toroidal volume 50 is lengthened or enlarged in a lengthened condition. The axial distance between the rear face 39 of the front flange 38 of the inner post 15 and the forward face 47 of the rear flange 46 of the fitting 14 is long or lengthened, as indicated by the dimension B shown in FIG. 4A. The progressive lock washer assembly 70 is loose, but maintains physical contact between the fitting 14 and the inner post 15 with the rearward lobes 62 and 63 of the wave washer 51 against the forward face 47 and the forward lobes (not pictured) of the lock washer 52 against the rear face 39. The wave washer 51 and lock washer 52 are nested against each other, with their forward lobes 60 and 61, and 75 and 76, registered with and in contact against each other, and with their rearward lobes 62 and 63, and 77 and 78, registered with and in contact against each other. The outer surface of the wave washer 51 is against the front face 71 of the lock washer 52. Both the inner and outer diameters of the lock washer 52 are reduced. As a result, the outer edge 74 of the lock washer 52 is radially separate from the plain inner surface 59 of the fitting 14, and the inner edge 73 is in contact with the fitting face 36. The outer diameter of the wave washer 51 is also reduced.

The toroidal volume 50 is uncompressed because the connector 50 is not yet tightened on the female post of the electronic component. Nevertheless, electrical continuity is maintained between the fitting 14 and the inner post 15 through the physical contact between those elements. The bowl-shaped configuration of both the wave washer 51 and the lock washer 52 produces a tension pressing axially outward, against the rear face 39 of the front flange 38 of the inner post 15 and the forward face 47 of the rear flange 46 of the fitting 14. This tension exerts an axial bias between the front flange 38 and the rear flange 46, which urges the toroidal volume 50, at all times, toward the lengthened dimension B.

When the connector 10 is to be installed on the electronic component, the fitting 14 is to be applied to the female post 80. When the fitting 14 is applied to the female post 80, the toroidal volume 50 changes, and the progressive lock washer assembly 70 changes as well. To apply the connector 10 onto the female post 80, the ring portion 42 of the fitting 14 is aligned with the female post 80 and the threaded inner surface 44 is threadably engaged with the female post 80 by rotating the fitting 14 onto the female post 80. Rotation is continued until the female post 80 (shown in broken line in FIG. 4B) is seated against the front 30 of the inner post 15 in contact therewith, thereby establishing electrical continuity between the female post 80 and the inner post 15. Seating the female post 80 in the fitting 14 against the inner post 15 causes the front flange 38 of the inner post 15 and the rear flange 46 of the fitting 14 to come together.

The toroidal volume 50 thus compresses or contracts from the lengthened condition shown in FIG. 4A to a contracted condition shown in FIG. 4B. In the contracted condition of the toroidal volume 50, the toroidal volume 50 acquires a contracted long dimension, as indicated by the dimension B' shown in FIG. 4B, which is shorter than the dimension B in FIG. 4A. In response, the progressive lock washer assembly 70 is compressed and flattened. Both the wave washer 51 and the lock washer 52 are compressed between the front flange 38 of the inner post 15 and the rear flange 46 of the fitting 14. When so compressed, the wave washer 51 enlarges radially to acquire inner and outer diameters which are larger than when the toroidal volume 50 is in the lengthened condition. When the wave washer 51 enlarges radially, its outer surface contacts the plain inner surface 59 of the fitting 14. Similarly, when compressed, the lock washer 52 enlarges radially to acquire inner and outer diameters which are larger than when the toroidal volume 50 is in the lengthened condition. When the lock washer 52 enlarges radially, its outer edge 74 contacts the plain inner surface 59 of the fitting 14. Compressed axially, both the wave washer 51 and the lock washer 52 exert a radial bias between the inner post 15 and the fitting 14, which thereby creates a tension between and limits rotation of the fitting 14 with respect to the inner post 15. In other words, when the fitting 14 is applied to the female post 80 and the female post 80 is seated therein, the contracted toroidal volume 50 compresses the progressive lock washer assembly 70 which in turn prevents the fitting 14 from being rotated. As such, the fitting 14 cannot inadvertently come loose from the female post 80.

Further, when the female post 80 is applied to and seated within the fitting 14, and the toroidal volume 50 is contracted, the wave washer 51 and the lock washer 52 each exert an axial bias between the front flange 38 of the inner post 15 and the rear flange 46 of the fitting 14. This causes the inner post 15 to be urged forwardly from the fitting 14, thereby urging and maintaining the physical contact between the female post 80 and the front 30 of the inner post 15, which prevents axial separation of the fitting 14 and the female post 80 and thus maintains electrical continuity between the two.

Figure 5A:
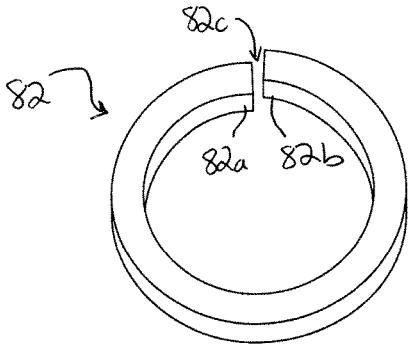
FIGS. 5A-5J are perspective views of lock washer embodiments.

FIGS. 5A-5J illustrate different embodiments of the lock washer. FIG. 5A illustrates a lock washer 82 having a helical body with a parallelogram cross-section formed with two free ends 82*a* and 82*b* defining a sever or gap 82*c*. The free ends 82*a* and 82*b* are aligned radially and are offset with respect to each other outside of a plane.

Figure 5B:
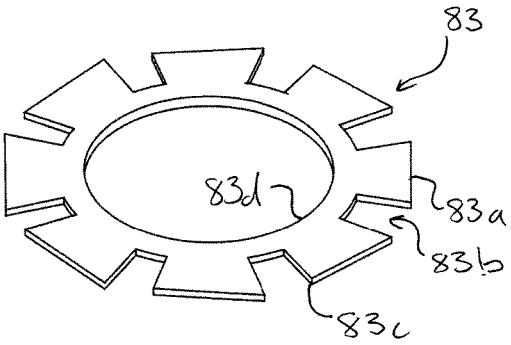

FIG. 5B illustrates an lock washer 83 characterized as an "external tooth washer" having a planar body with an irregular cross-section. The body is continuous and unbroken. The lock washer 83 includes outwardly-directed teeth 83*a* circumferentially spaced apart by wedge-shaped notches 83*b* on an outer edge 83*c* of the lock washer 83. An inner edge 83*d* of the lock washer 83 is circular, continuous, and smooth.

Figure 5C:
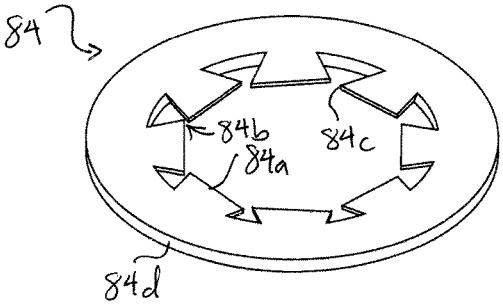

FIG. 5C illustrates a lock washer 84 characterized as an "internal tooth washer" having a planar body with an irregular cross-section. The body is continuous and unbroken. The lock washer 84 includes inwardly-directed teeth 84*a* circumferentially spaced apart by substantially triangular-shaped notches 84*b* on an inner edge 84*c* of the lock washer 84. An outer edge 84*d* of the lock washer 84 is circular, continuous, and smooth.

Figure 5D:
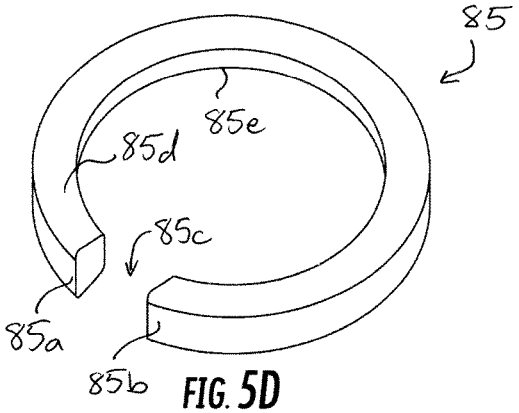

FIG. 5D illustrates a lock washer 85 having a planar body with a trapezoidal cross-section, characterized as a "trapezoidal washer." The body is severed; opposed free ends 85*a* and 85*b* are separated by a larger sever or gap 85*c*. The lock washer 85 includes a front face 85*d* and an opposed rear face 85*e*, which are transverse to each other and converge generally toward a geometric center of the lock washer 85. The free ends 85*a* and 85*b* are radially aligned.

Figure 5E:
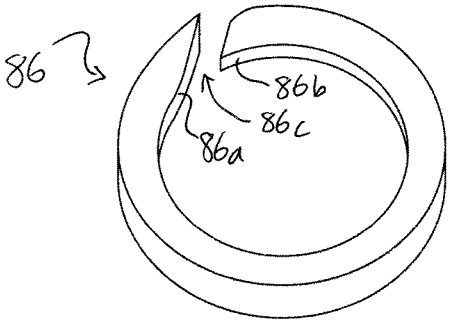

FIG. 5E illustrates a lock washer 86 having a planar body with a square cross-section. The body is severed; opposed free ends 86*a* and 86*b* are separated by a large oblique sever or gap 86*c*. The free ends 82*a* and 82*b* extend obliquely through the body of the lock washer 86 and are not radially-aligned. The lock washer 86 is characterized as an "oblique sever washer."

Figure 5F:
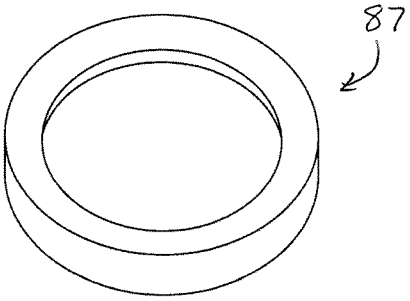

FIG. 5F illustrates a lock washer 87 having a planar body with a square cross-section. The lock washer 87 is continuous and not severed. The lock washer 87 is characterized as a "ring washer."

Figure 5G:
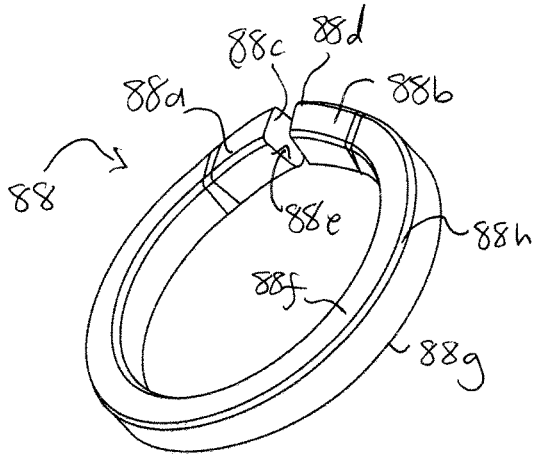

FIG. 5G illustrates a lock washer 88 having a non-planar body with a square cross-section. The body is planar around substantially its entire periphery but for opposed legs 88*a* and 88*b* terminating in free ends 88*c* and 88*d*, respectively, which bounds a sever or gap 88*e*. The legs 88*a* and 88*b* rise out of the plane of the body in the same direction and at the same low-rise angle. The free ends 88*c* and 88*d* are not parallel; they are radially aligned but are also convergent between front and rear faces 88*f* and 88*g* of the lock washer 88. The corners of the lock washer 88 are formed with chamfers 88*g*. The lock washer 88 is characterized as a "split ring riser washer."

Figure 5H:
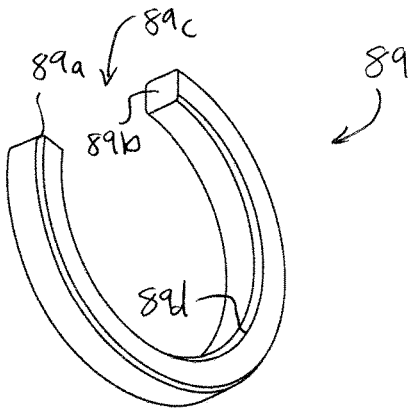

FIG. 5H illustrates a lock washer 89 having a planar body with a square cross-section. The lock washer 89 includes two free ends 89*a* and 89*b*, which are spaced apart by a quarter-arc sever or gap 89*c*. In other words, the body of the lock washer 89 has a continuous length from the free end 89*a* to the free end 89*b* around a three-quarters arc of a circle, but the final quarter-arc is the gap 89*c*. The corners of the lock washer 89 are formed with chamfers 89*d*. The lock washer 89 is characterized as a "three quarter washer."

Figure 5I:
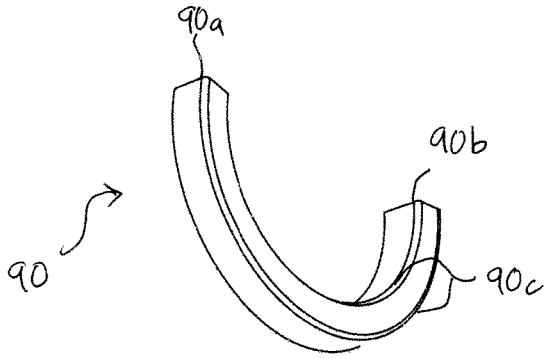

FIG. 5I illustrates a lock washer 90 having a planar body with a square cross-section. The lock washer 90 is semicircular: two opposed free ends 90*a* and 90*b* terminate at diametrically offset locations on the lock washer 90. The free ends 90*a* and 90*b* are parallel, and the corners of the lock washer are formed with chamfers 90*c*. The lock washer 90 is characterized as a "semicircular washer."

Figure 5J:
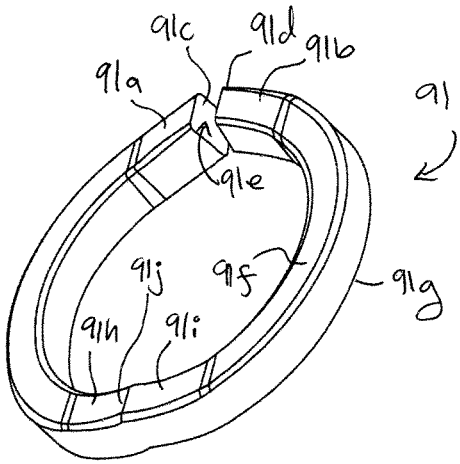

FIG. 5J illustrates a lock washer 91 similar to the lock washer 88. The lock washer 91 has a non-planar body with a square cross-section. The body is planar around substantially its entire periphery but for opposed legs 91*a* and 91*b* terminating in free ends 91*c* and 91*d*, respectively, bounding a sever or gap 91*e*. The legs 91*a* and 91*b* rise out of the plane of the body in the same direction and at the same low-rise angle. The free ends 91*c* and 91*d* are not parallel; they are radially aligned but are also convergent between front and rear faces 91*f* and 91*g* of the lock washer 91. Opposite the legs 91*a* and 91*b* are two rises 91*h* and 91*i* in the body which rise out of the plane of the body in the same direction and at the same low-rise angle. The rises 91*h* and 91*i* rise at the same low-rise angle as the legs 91*a* and 91*b*, and they rise to a crown 91*j*. The corners of the lock washer 91 are formed with chamfers 91*k*. The lock washer 91 is characterized as a "split ring double riser washer."

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A cable connector comprising:

a body including a longitudinal axis, an inner post, and an outer barrel and a fitting each mounted to the inner post;

the inner post includes a front, an opposed rear, and an outwardly-directed front flange at the front;

the fitting includes a front and rear, and an inwardly-directed rear flange at the rear;

the fitting is mounted on the inner post so that the front and rear flanges overlap to define a toroidal volume;

a wave washer and a lock washer nested against each other, each carried in the toroidal volume, wherein the waver washer has a circular cross-section and includes two opposed forward lobes defining convex sections of the wave washer and two opposed rearward lobes defining concave sections of the wave washer, and each forward lobe of the wave washer is circumferentially spaced apart from the rearward lobes of the wave washer by a quarter-arc of the wave washer, and the lock washer has a parallelogram cross-section and includes two opposed forward lobes defining convex sections of the wave washer and two opposed rearward lobes defining concave sections of the wave washer, and each forward lobe of the lock washer is circumferentially spaced apart from the rearward lobes of the wave washer by a quarter-arc of the lock washer; and when the fitting is applied to a female post, the wave washer and the lock washer are compressed between the front and rear flanges and exert an axial bias on the front and rear flanges to prevent axial separation of the fitting and the female post.

2. The connector of claim 1, wherein the wave washer is disposed in front of the lock washer in the toroidal volume.

3. The connector of claim 1, wherein the toroidal volume moves between a lengthened condition and a contracted condition when the fitting is applied to the female post, and the wave washer and the lock washer are compressed in response thereto.

4. A cable connector comprising:

a body including a longitudinal axis, an inner post, and an outer barrel and a fitting each mounted to the inner post;

the inner post includes a front, an opposed rear, and an outwardly-directed front flange at the front;

the fitting includes a front and rear, and an inwardly-directed rear flange at the rear;

the fitting is mounted on the inner post so that the front and rear flanges overlap to define a toroidal volume;

a wave washer and a lock washer nested against each other, each carried in the toroidal volume, wherein the waver washer has a circular cross-section and includes two opposed forward lobes defining convex sections of the wave washer and two opposed rearward lobes defining concave sections of the wave washer, and each forward lobe of the wave washer is circumferentially spaced apart from the rearward lobes of the wave washer by a quarter-arc of the wave washer, and the lock washer has a parallelogram cross-section and includes two opposed forward lobes defining convex sections of the wave washer and two opposed rearward lobes defining concave sections of the wave washer, and each forward lobe of the lock washer is circumferentially spaced apart from the rearward lobes of the wave washer by a quarter-arc of the lock washer; and when the fitting is applied to a female post, the wave washer enlarges radially and exerts a radial bias between the inner post and the fitting to limit rotation of the fitting with respect to the inner post.

5. The connector of claim 4, wherein the wave washer is disposed in front of the lock washer in the toroidal volume.

6. The connector of claim 4, wherein the toroidal volume moves between a lengthened condition and a contracted condition when the fitting is applied to the female post, and the wave washer enlarges radially in response thereto.

7. A cable connector comprising:

a body including a longitudinal axis, an inner post, and an outer barrel and fitting each mounted to the inner post;

the inner post includes a front, an opposed rear, and an outwardly-directed front flange at the front;

the fitting includes a front and rear, and an inwardly-directed rear flange at the rear;

the fitting is mounted on the inner post so that the front and rear flanges overlap to define a toroidal volume;

a wave washer and a lock washer nested against each other, each carried in the toroidal volume, wherein the waver washer has a circular cross-section and includes two opposed forward lobes defining convex sections of the wave washer and two opposed rearward lobes defining concave sections of the wave washer, and each forward lobe of the wave washer is circumferentially spaced apart from the rearward lobes of the wave washer by a quarter-arc of the wave washer, and the lock washer has a parallelogram cross-section and includes two opposed forward lobes defining convex sections of the wave washer and two opposed rearward lobes defining concave sections of the wave washer, and each forward lobe of the lock washer is circumferentially spaced apart from the rearward lobes of the wave washer by a quarter-arc of the lock washer; and when the fitting is applied to a female post, the wave washer and the lock washer are compressed between the front and rear flanges and exert an axial bias on the front and rear flanges to prevent axial separation of the fitting and the female post, and the wave washer enlarges radially and exerts a radial bias between the inner post and the fitting to limit rotation of the fitting with respect to the inner post.

8. The connector of claim 7, wherein the wave washer is disposed in front of the lock washer in the toroidal volume.

9. The connector of claim 7, wherein the toroidal volume moves between a lengthened condition and a contracted condition when the fitting is applied to the female post, and the wave washer and the lock washer are compressed and the wave washer enlarges radially in response thereto.

10. The connector of claim 7, wherein the lock washer is selected from the group consisting of a split ring washer, an external tooth washer, an internal tooth washer, a trapezoidal washer, an oblique sever washer, a ring washer, a split ring riser washer, a three quarter washer, a semicircular washer, and a split ring double riser washer.

* * * * *